US008365522B2

(12) United States Patent
Abram et al.

(10) Patent No.: US 8,365,522 B2
(45) Date of Patent: Feb. 5, 2013

(54) DUAL EXHAUST SYSTEM WITH INDEPENDENT VALVE CONTROL

(75) Inventors: Kwin Abram, Columbus, IN (US); Ivan Arbuckle, Columbus, IN (US); Joseph E. Callahan, Greenwood, IN (US); James Egan, Indianapolis, IN (US); Robin Willats, Columbus, IN (US)

(73) Assignee: Emcon Technologies LLC, Wilmington, DE (US)

( * ) Notice: Subject to any disclaimer, the term of this patent is extended or adjusted under 35 U.S.C. 154(b) by 612 days.

(21) Appl. No.: 12/541,992

(22) Filed: Aug. 17, 2009

(65) Prior Publication Data

US 2010/0043398 A1 Feb. 25, 2010

Related U.S. Application Data

(60) Provisional application No. 61/090,676, filed on Aug. 21, 2008.

(51) Int. Cl.
*F01N 1/00* (2006.01)

(52) U.S. Cl. ..... 60/324; 60/274; 181/253; 181/254

(58) Field of Classification Search ..... 60/287, 60/313, 322–324; 181/253, 254
See application file for complete search history.

(56) References Cited

U.S. PATENT DOCUMENTS

| | | | | |
|---|---|---|---|---|
| 3,957,444 | A * | 5/1976 | Goto et al. | 422/111 |
| 6,454,047 | B1 * | 9/2002 | Galaitsis | 181/254 |
| 6,662,554 | B2 * | 12/2003 | Sheidler et al. | 60/290 |
| 6,755,279 | B2 * | 6/2004 | Kaneko et al. | 181/232 |
| 6,938,729 | B2 * | 9/2005 | Worner et al. | 181/254 |
| 7,040,451 | B2 * | 5/2006 | Schumacher et al. | 181/254 |
| 7,434,570 | B2 * | 10/2008 | Hill | 123/568.18 |
| 7,703,574 | B2 * | 4/2010 | Kruger et al. | 181/254 |

* cited by examiner

*Primary Examiner* — Thomas Denion
*Assistant Examiner* — Diem Tran
(74) *Attorney, Agent, or Firm* — Carlson, Gaskey & Olds, PC

(57) ABSTRACT

A dual exhaust system includes a first exhaust component defining a first exhaust path and a second exhaust component defining a second exhaust path that is different from the first exhaust path. A first valve is associated with the first exhaust path and a second valve is associated with the second exhaust path. The first valve and second valve operate independently of each other to vary exhaust flow and provide sufficient noise control for varying applications.

9 Claims, 1 Drawing Sheet

DUAL EXHAUST SYSTEM WITH INDEPENDENT VALVE CONTROL

RELATED APPLICATION

This application claims priority to U.S. Provisional Application No. 61/090,676, which was filed on Aug. 21, 2008.

TECHNICAL FIELD

This invention generally relates to a dual exhaust system for a vehicle including at least one valve within each exhaust path wherein the valves are controlled independently of each other.

BACKGROUND OF THE INVENTION

A dual exhaust system, which is typical for V8 or V6 engines, includes two parallel exhaust paths with a local interconnection that links the exhaust paths together. In a standard configuration, one exhaust path is associated with one set of engine cylinders (one set of 3 (V6) or 4 (V8) cylinders) and the other exhaust path is associated with the other set of engine cylinders (the other 3 (V6) or 4 (V8) cylinders). Each exhaust path extends from the respective set of cylinders at the engine to a separate muffler, i.e. each exhaust path extends to its own muffler. Exhaust gases exit the system through one or more outlet tailpipes. The local interconnection between the two exhaust paths is typically a balance pipe that is used to link the two paths together at a position upstream of the mufflers.

In some configurations, each exhaust path has a valve that is used to vary exhaust flow for acoustic purposes and/or for operating efficiency of the exhaust system or engine. One valve is associated with each exhaust path. The valves are of the same design and are controlled together. This type of configuration does not effectively operate to provide sufficient noise control for varying applications.

SUMMARY OF THE INVENTION

A dual exhaust system includes first and second exhaust paths that are different from each other. Each exhaust path has at least one valve that is operated independently of the other to vary exhaust flow and provide sufficient noise control for varying applications.

In one example, a first exhaust component defines the first exhaust path and a second exhaust component defines the second exhaust path. The first and second exhaust paths can be symmetrical or asymmetrical relative to each other. A first valve is positioned within the first exhaust path and a second valve is positioned within the second exhaust path. The first and second exhaust valves are independently operable of each other.

At least one of the first and second valves is an actively controlled valve. In one example, one of the first and second valves comprises an actively controlled valve and the other of the first and second valves comprises a passive valve. In another example, both the first and second valves comprise actively controlled valves. The actively controlled valves can comprise continuously variable position valves moveable between an infinite number of positions and/or can comprise valves that are movable between a discrete number of positions.

In one example, a controller is associated with the actively controlled valves and is used to control movement between various operational positions. In certain applications, the controller identifies when an engine is operating in a full operational mode with all engine cylinders being operational or in a deactivated mode where a reduced number of engine cylinders are operational. In one example, the controller is configured to actively vary valve position in full and deactivated modes to influence sound quality in addition to controlling a balance of sound attenuation versus noise reduction when operating in a deactivated mode.

These and other features of the present invention can be best understood from the following specification and drawings, the following of which is a brief description.

DETAILED DESCRIPTION OF THE PREFERRED EMBODIMENT

Figure 1:
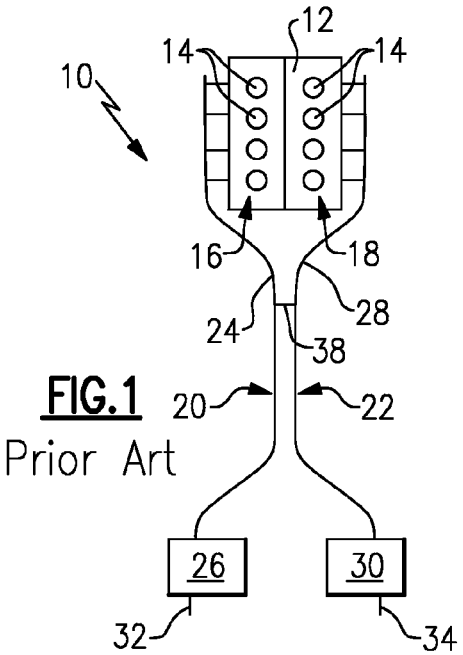
FIG.1 Prior Art
FIG. 1 is a schematic representation of a prior art dual exhaust system without valves.

A conventional dual exhaust system 10 is shown in FIG. 1, and is associated with an engine 12 having a plurality of cylinders 14. The engine of FIG. 1 comprises a V8 engine 12 having a first set of cylinders 16 and a second set of cylinders 18, with each set including four cylinders. A first exhaust path 20 is associated with the first set of cylinders 16 and a second exhaust path 22 is associated with the second set of cylinders 18. The second exhaust path 22 is parallel to and symmetrical with the first exhaust path 20.

A first set of exhaust pipes 24 of the first exhaust path 20 extend from the engine 12 to a first muffler 26. A second set of exhaust pipes 28 of the second exhaust path 22 extend from the engine to a second muffler 30. The first muffler 26 includes at least one tailpipe 32 and the second muffler 30 includes at least one tailpipe 34. An interconnection pipe 38 connects the first 20 and second 22 exhaust paths.

In the example of FIG. 1, no valves are used. Such a configuration is typically utilized in a sport application where noise, fuel economy, etc. are not of primary concern.

Figure 2:
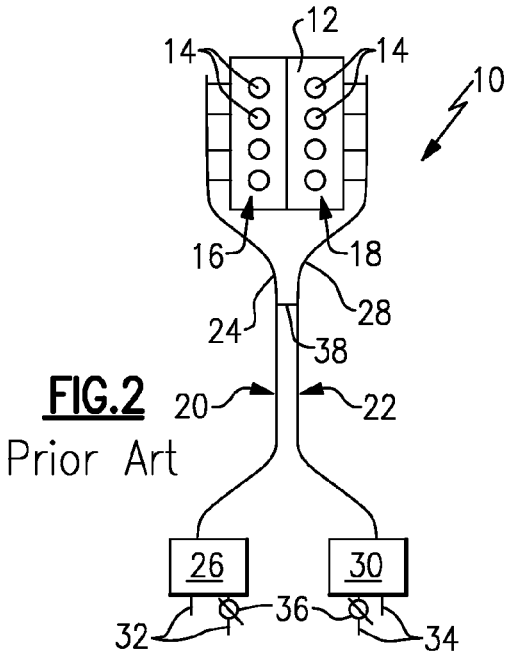
FIG.2 Prior Art
FIG. 2 is a schematic representation of a prior art dual exhaust system with valves.

FIG. 2 shows a conventional system similar to that of FIG. 1, but which includes one valve 36 in each of the first 20 and second 22 exhaust paths. These valves 36 are of the same design and operate together as a unit. This configuration is typically used to provide additional acoustic damping for sports cars requiring additional noise control. However, this traditional configuration does not provide sufficient noise control for other types of vehicle applications.

Figure 3A:
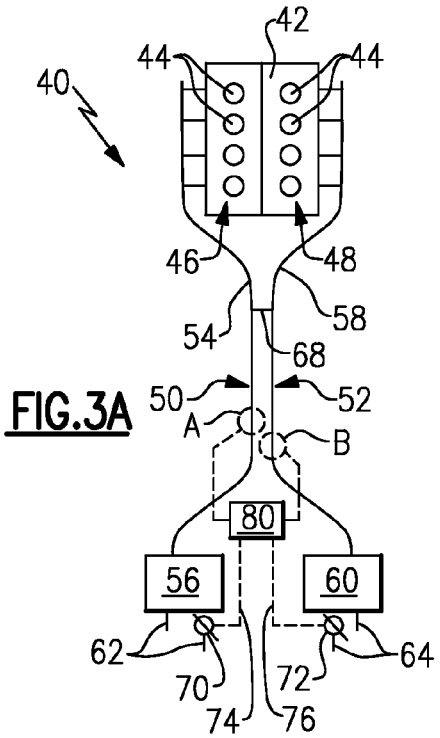
FIG. 3A is a schematic representation of a dual exhaust system having a symmetrical configuration, and which incorporates the subject invention.
Figure 3B:
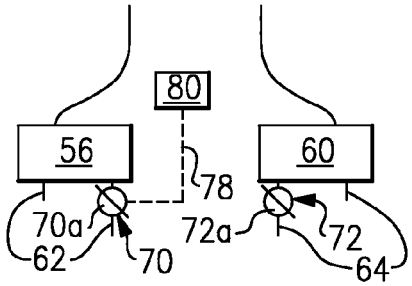
FIG. 3B is similar to FIG. 3A but shows an optional valve combination.

A more effective dual exhaust system 40, which provides an improved sound quality, is shown in FIGS. 3A and 3B. This dual exhaust system 40 is associated with an engine 42 having a plurality of cylinders 44. In this example, a V8 engine 42 is shown which includes a first set of cylinders 46 and a second set of cylinders 48, with each set including four cylinders. A first exhaust path 50 is associated with the first set of cylinders 46 and a second exhaust path 52 is associated with the second set of cylinders 48. The second exhaust path 52 is parallel to and symmetrical with the first exhaust path 50.

A first set of exhaust pipes 54 of the first exhaust path 50 extend from the engine 42 to a first muffler 56. A second set of exhaust pipes 58 of the second exhaust path 52 extend from the engine 42 to a second muffler 60. The first muffler 56 includes at least one tailpipe 62 and the second muffler 60 includes at least one tailpipe 64; however each muffler could also include an additional tailpipe or tailpipes. Further, it should be understood that additional exhaust components could be connected to the first 54 or second 58 sets of exhaust pipes and located along the first and/or second exhaust paths. An interconnection pipe 68 connects the first 50 and second 52 exhaust paths at a location upstream of the first 56 and second 60 mufflers. The interconnection pipe 68 is also referred to as a balance pipe.

A first valve 70 is associated with the first exhaust path 50 and a second valve 72 is associated with the second exhaust path 52. At least one of the first 70 and second 72 valves comprises an actively controlled valve. The other of the first 70 and second 72 valves can comprise either an actively or passively controlled valve depending upon the application. A controller 80 is associated with the actively controlled valves and generates control signals that control movement between various operational positions, which include at least an open position and a closed position. In the example shown in FIGS. 3A-3B, the first 70 and second 72 valves are positioned within the respective tailpipes 62, 64; however, the first 70 and second 72 valves could be located anywhere within the respective exhaust paths 50, 52, as indicated at A, B. Further, each exhaust path 50, 52 could include more than one valve.

In one example shown in FIG. 3A, the first 70 and second 72 valves both comprise actively controlled valves, such as electrically actuated valves for example. These electrically actuated valves can be continuously variable position valves moveable between an infinite number of positions, or can be valves that are moveable between a discrete number of positions. Each valve 70, 72 has a different valve position control input to change flow and acoustic mixing in each of the associated first 50 and second 52 exhaust paths for optimization of sound quality.

The controller 80 generates a first control signal 74 that controls operation of the first valve 70 and generates a second control signal 76 that controls operation of the second valve 72. The controller 80 generates the control signals 74, 76 to control movement and position of the first valve 70 independent of the second valve 72. The controller 80 can generate the control signals 74, 76 simultaneously or sequentially; however, in either situation, the first control signal 76 moves the first valve 70 to a desired position that is independent of a position of the second valve 72 and the second control signal 78 moves the second valve 72 to a desired position that is independent of the position of the first valve 70. The controller 80 independently operates position/movement of the first 70 and second 72 valves from each other to provide optimization of sound quality.

In another example, one of the first 70 and second 72 valves in FIG. 3A comprises an actively controlled valve, such as a continuously variable position electrically actuated valve for example, and the other of the first 70 and second 72 valves comprises an actively controlled valve that is moveable between a discrete number of positions. For example, the other of the first 70 and second 72 valves could comprise a two position valve moveable between an open position for maximum exhaust gas flow and a closed position for minimal or no exhaust gas flow. The controller 80 independently controls the positions of the first 70 and second 72 valves to produce desired sound quality and backpressure levels. The controller generates control signals 74, 76 to control the position of the valves 70, 72 in a manner similar to that described above. This configuration provides a more cost effective solution than using two continuously variable electric actuated valves.

In another example shown in FIG. 3B, one of the first 70 and second 72 valves comprises an actively controlled valve, such as an electrically actuated valve shown as 70*a* for example, and the other of the first 70 and second 72 valves comprises a passive valve as indicated at 72*a*. The passive valve 72*a* comprises a spring loaded, flow actuated valve that is utilized to reduce valve costs. The controller 80 generates a control signal 78 to actively control movement/position of the actively controlled valve 70*a* while the passive valve 72*a* operates solely in response to spring loads and exhaust gas flow pressures. As such, movement of the first 70*a* and second 72*a* valves is independent of each other to provide for optimization of sound quality.

Figure 4:
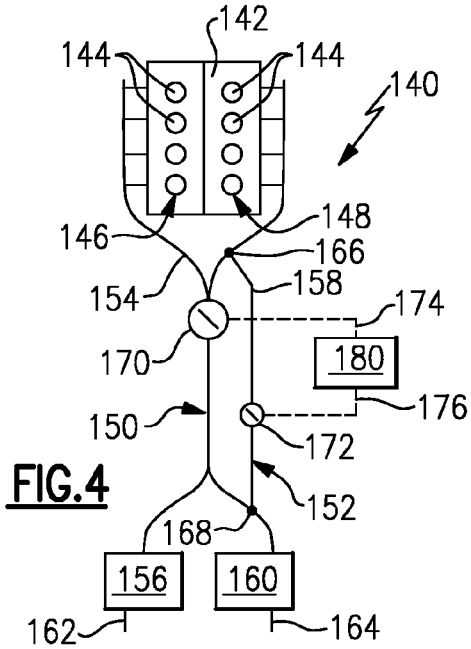
FIG. 4 is a schematic representation of a dual exhaust system having an asymmetrical configuration, and which incorporates the subject invention.

FIG. 4 shows an exhaust system 140 that is similar to that of FIG. 3, but which has an asymmetrical configuration. This type of configuration independently operates valves in each exhaust path to switch between smooth and modulated exhaust sound. FIG. 4 shows a dual exhaust system 140 that is associated with an engine 142 having a plurality of cylinders 144. In this example a V8 engine 142 is shown, which includes a first set of cylinders 146 and a second set of cylinders 148, with each set including four cylinders. A first exhaust path 150 is associated with the first set of cylinders 146 and a second exhaust path 152 is associated with the second set of cylinders 148.

A first set of exhaust pipes 154 of the first exhaust path 150 extend from the engine 142 to a first muffler 156. A second set of exhaust pipes 158 of the second exhaust path 152 extend from the engine 142 to a second muffler 160. The first muffler 156 includes at least one tailpipe 162 and the second muffler 160 includes at least one tailpipe 164; however each muffler could also include an additional tailpipe. Further, it should be understood that additional exhaust components could be connected to the first 154 or second 158 sets of pipes and located along the first and/or second exhaust paths.

In the example shown in FIG. 4, the first exhaust path 150 and the second exhaust path 152 provide an asymmetrical exhaust configuration. The first exhaust path 150 comprises a primary exhaust path that receives exhaust gases from both the first 146 and second 148 sets of cylinders. The second exhaust path 152 comprises a secondary path that has a first connection interface 166 positioned at an upstream location that only receives exhaust gas flow from the second set of cylinders 148. This secondary path also includes a second connection interface 168 that is positioned at a downstream location that only provides exhaust gas flow to the second muffler 160. The primary exhaust path can provide exhaust gas flow to both the first 156 and second 160 mufflers.

A first valve 170 is associated with the first exhaust path 150 and a second valve 172 is associated with the second exhaust path 152. At least one of the first 170 and second 172 valves comprises an actively controlled valve. The other of the first 170 and second 172 valves can comprise either an actively or passively controlled valve (see FIG. 3B for example) depending upon the application. Thus, for example, the first 170 and second 172 valves of FIG. 4 can comprises any of the various configurations/combinations as discussed above with regard to FIGS. 3A and 3B.

A controller 180 is associated with the actively controlled valves and is used to control movement between various operational positions, which include at least an open position and a closed position. In the example shown in FIG. 4, the first valve 170 is located within the primary exhaust path at a location between the first 166 and second 168 connection interfaces. The second valve 172 is positioned in the secondary exhaust path 152 downstream of the first connection interface 166 and upstream of the second connection interface. While each exhaust path 150, 152 includes only one valve, additional valves could be included if needed.

In one example, the first valve 170 in the primary exhaust path 150 comprises an actively controlled valve, such as a throttling continuously variable position valve for example, while the second valve 172 in the secondary exhaust path 152 comprises an actively controlled valve that is moveable between a discrete number of positions. The controller generates control signals 174, 176 to control movement/position of each valve independent of a position of the other valve. In one example configuration, the first valve 170 controls exhaust noise levels vs. restriction while the second valve 172 can be moved to open and close the secondary exhaust path 152 for increased flow and modulated exhaust sound.

An application of the asymmetrical valve layout such as that of FIG. 4 is beneficial for adjusting exhaust flow and acoustic function to suit multiple cylinder deactivation configurations, such as full operation, e.g. full V8 mode, and a cylinder deactivated mode, e.g. V4 mode. This is beneficial because in cylinder deactivation the exhaust system can be configured to flow through a single inter-pipe causing reduction of exhaust noise, while allowing further control through operation of the continuously variable valve.

The controller 180 can be incorporated as part of an engine control unit (ECU) that controls the operation of the engine in either the full or deactivated operational mode, or can comprise a separate controller 180 receives input from the ECU. In either configuration, the controller 180 can identify which operational mode the engine is operating in and can subsequently control a position of one or more of the valve(s) 170, 172 as needed to optimize sound quality.

In one example, the position of the continuously variable valve can be varied in full and deactivated modes to influence sound quality, and can beneficially control balance of sound attenuation vs. noise reduction in the cylinder deactivation mode. The second valve 172 is open in full cylinder operation such that exhaust gas flow can pass down both inter-pipes as would occur in a conventional parallel/symmetrical V8 system. The second valve 172 is closed for reduced cylinder operation, e.g. cylinder deactivation mode, where all flow must flow through the inter-pipe of the primary exhaust path.

It should be understood that while a V8 engine is shown, the subject exhaust system could also be used with other engines having different cylinder configurations, such as a V6 configuration for example. Further, the above described method of control is just one example of a control strategy, and other control strategies could also be used.

In one example, active control of the electrically actuated valves is based on the concept of providing improved fuel economy without adversely affecting noise levels. Such a control configuration is set forth in U.S. application Ser. No. 12/195,759 filed on Aug. 21, 2008, and which is owned by the owner of the present application and herein incorporated by reference.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A dual exhaust system comprising:

at least one first exhaust component defining a first exhaust path that comprises a primary exhaust path to extend from an engine to an exhaust outlet;

at least one second exhaust component defining a second exhaust path different from said first exhaust path, wherein said second exhaust path comprises a secondary exhaust path that extends from a first connection interface at an upstream location of said primary exhaust path to a second connection interface at a downstream location of said primary exhaust path;

wherein said primary exhaust path extends from a first set of engine cylinders to a first muffler and said secondary exhaust path extends from a second set of engine cylinders to a second muffler, and wherein said primary exhaust path is configured to selectively direct exhaust gas from said first and second sets of engine cylinders to flow to both of said first and said second mufflers with said secondary exhaust path only to direct exhaust gas from said second set of engine cylinders to said second muffler;

at least one first valve associated with said first exhaust path; and at least one second valve associated with said second exhaust path, wherein said at least one first valve and said at least one second valve operate independently of each other to vary exhaust flow.

2. A dual exhaust system comprising:

a first exhaust path to extend from a first set of engine cylinders to at least one of a first muffler and a second muffler;

a second exhaust path to only extend from a second set of engine cylinders to the second Muffler, wherein the first exhaust path extends to both the first and second mufflers, and wherein the second exhaust path only extends to the second muffler;

at least one first valve associated with said first exhaust path;

at least one second valve associated with said second exhaust path wherein at least one of said first and said second valves comprises an actively controlled valve; and a controller generating a control signal to vary a position of said actively controlled valve independently of a position of the other of said first and said second valves.

3. The dual exhaust system according to claim 2, wherein said other of said first and said second valves comprises a passive valve.

4. The dual exhaust system according to claim 2, wherein said other of said first and said second valves comprises an actively controlled valve.

5. The dual exhaust system according to claim 2, wherein said controller determines whether an engine is operating in a full cylinder operational mode or a deactivated cylinder operational mode, and wherein said controller controls a position of said actively controlled valve dependent on whether the engine is operating in said full or deactivated cylinder operational mode.

6. The dual exhaust system according to claim 2, wherein said first and said second exhaust paths are symmetrically configured relative to each other with said first exhaust path to extend directly from the first set of engine cylinders to said outlet from said first muffler and with said second exhaust path to extend from the second set of engine cylinders to said outlet from said second muffler, and including an interconnection pipe extending between said first and said second exhaust paths upstream of said first and said second mufflers.

7. The dual exhaust system according to claim 2, wherein the first exhaust path extends to the first muffler, and wherein the second exhaust path only extends to the second muffler.

8. A dual exhaust system comprising:

a first exhaust path to extend from a first set of engine cylinders to a first muffler;

a second exhaust path to extend from a second set of engine cylinders to a second muffler;

at least one first valve associated with said first exhaust path;

at least one second valve associated with said second exhaust path wherein at least one of said first and said second valves comprises an actively controlled valve;

a controller generating a control signal to vary a position of said actively controlled valve independently of a position of the other of said first and said second valves; and wherein said first and said second exhaust paths are asymmetrically configured relative to each with said first exhaust path comprising a primary exhaust path to extend from the first and second sets of engine cylinders to said outlets of said first and said second mufflers, and wherein said second exhaust path comprises a secondary exhaust path that extends from a first connection interface at an upstream location of said primary exhaust path to a second connection interface at a downstream location of said primary exhaust path such that said controller to selectively direct exhaust gas through said primary exhaust path from the first and second sets of engine cylinders to both of said first and said second mufflers by generating a first control signal to prevent exhaust gas from flowing through said secondary exhaust path, and wherein said controller selectively generates a second control signal to open flow through said secondary flow path with said secondary exhaust path only to direct exhaust gas from said second set of engine cylinders to said second muffler.

9. A dual exhaust system comprising:

a first exhaust path to extend from a first set of engine cylinders o at least one of a first muffler and a second muffler;

a second exhaust path to only extend from a second set of engine cylinders to the second muffler;

at least one first valve associated with said first exhaust path;

at least one second valve associated with said second exhaust path wherein at least one of said first and said second valves comprises an actively controlled valve; and a controller generating a control signal to vary a position of said actively controlled valve independently of a position of the other of said first und said second valves, and wherein the second exhaust path extends from the second set of engine cylinders to an exhaust gas outlet at one or more tailpipes, and wherein the only muffler in the second exhaust path is the second muffler.

* * * * *